US010676233B2

(12) United States Patent
Wolf

(10) Patent No.: US 10,676,233 B2
(45) Date of Patent: Jun. 9, 2020

(54) DIVIDED CONTAINER

(71) Applicant: LBP Manufacturing LLC, Cicero, IL (US)

(72) Inventor: Kurt Wolf, Chicago, IL (US)

(73) Assignee: LBP Manufacturing LLC, Cicero, IL (US)

( * ) Notice: Subject to any disclaimer, the term of this patent is extended or adjusted under 35 U.S.C. 154(b) by 0 days.

(21) Appl. No.: 16/400,838

(22) Filed: May 1, 2019

(65) Prior Publication Data

US 2019/0337671 A1 Nov. 7, 2019

Related U.S. Application Data

(60) Provisional application No. 62/665,954, filed on May 2, 2018.

(51) Int. Cl.
*B65D 5/48* (2006.01)
*B65D 5/66* (2006.01)
*B65D 5/28* (2006.01)

(52) U.S. Cl.
CPC ..... *B65D 5/48018* (2013.01); *B65D 5/28* (2013.01); *B65D 5/6655* (2013.01)

(58) Field of Classification Search
CPC .... B65D 5/48018; B65D 5/28; B65D 5/6655; B65D 2585/366; B65D 5/48002; B65D 81/32; B65D 2581/3406
USPC ..... 229/120.32, 906, 120.21, 114, 146, 902, 229/903, 120.18, 148, 149, 931, 120.08; 220/4.23; 206/561
See application file for complete search history.

(56) References Cited

U.S. PATENT DOCUMENTS 2,510,211 A * 6/1950 Cleary ..... B65D 5/48046 229/120.32
2,850,224 A 9/1958 Meinhardt
2,852,177 A * 9/1958 Frasch ..... B65D 5/28 229/120.32
4,232,816 A * 11/1980 Johnson ..... B65D 5/2047 229/114
4,293,091 A 10/1981 Gerard
4,498,420 A * 2/1985 Botterman ..... A01K 67/033 119/6.5
4,649,714 A 3/1987 Lee
4,836,367 A 6/1989 Golkar
4,836,383 A * 6/1989 Gordon ..... B65D 5/48014 219/730
4,844,330 A 7/1989 Roosa et al.
4,951,866 A * 8/1990 Rusnak ..... B65D 25/08 206/561
4,957,237 A 9/1990 Madonna
(Continued)

*Primary Examiner* — Christopher R Demeree
(74) *Attorney, Agent, or Firm* — Fitch, Even, Tabin & Flannery LLP

(57) ABSTRACT

A container is provided including a container body having an interior space. The container body has a base portion, a top portion pivotally connected to the base portion, and a divider wall that separates upper and lower portions of the interior space with the top portion closed on the base portion. A slot of the container body is disposed generally between the upper and lower portions of the interior space, and a projection of the divider wall sized to fit into the slot to support the divider wall in an operable position between the upper and lower portions of the interior space with the top portion closed on the base portion.

16 Claims, 5 Drawing Sheets

(56) References Cited

U.S. PATENT DOCUMENTS

| | | | | | |
|---|---|---|---|---|---|
| 5,012,971 | A * | 5/1991 | Cozzi | B65D 5/48024 | 220/4.23 |
| 5,039,003 | A | 8/1991 | Gordon | | |
| 5,049,710 | A | 9/1991 | Prosise | | |
| 5,335,845 | A | 8/1994 | Liu | | |
| 5,445,314 | A * | 8/1995 | Newsome | B65D 5/48014 | 229/120.21 |
| 5,495,983 | A | 3/1996 | Lelek | | |
| 5,520,324 | A | 5/1996 | Cai | | |
| 5,601,231 | A | 2/1997 | Cai | | |
| 5,718,370 | A * | 2/1998 | Lafferty | B65D 81/3453 | 229/120.18 |
| 5,878,945 | A | 3/1999 | Weder | | |
| 5,909,840 | A | 6/1999 | Schultheiss | | |
| 6,386,440 | B1 * | 5/2002 | Tulkoff | B65D 5/48024 | 229/120.06 |
| 7,980,454 | B2 | 7/2011 | Burton | | |
| D679,198 | S | 4/2013 | Gartz | | |
| 8,733,622 | B2 * | 5/2014 | Learn | B65D 5/667 | 229/114 |
| 8,733,626 | B2 | 5/2014 | Learn | | |
| 8,770,466 | B1 | 7/2014 | Terlesky | | |
| 9,180,997 | B2 | 11/2015 | Melistas | | |
| 9,469,458 | B2 | 10/2016 | Padda | | |
| 10,086,972 | B2 * | 10/2018 | Hajek | B65D 5/2057 | |
| 2012/0111931 | A1 * | 5/2012 | Kimhi | B65D 85/36 | 229/120 |
| 2016/0159515 | A1 | 6/2016 | Putko | | |

* cited by examiner

DIVIDED CONTAINER

CROSS-REFERENCE TO RELATED APPLICATIONS

This application claims the benefit of U.S. Provisional Application No. 62/665,954, filed on May 2, 2018.

TECHNICAL FIELD

This invention relates generally to containers, and more specifically relates to containers having dividers.

BACKGROUND

Prepared food products are frequently sold in disposable containers. The containers house the food products for a period of time until they are consumed. For example, takeout food containers can house food for the duration of a trip home, and then can be opened so that the food can be consumed at that time.

Some food products include ingredients of different temperatures and/or moisture contents. For example, a hot sandwich, such as a hamburger, may have cold toppings, such as lettuce, tomatoes, onion, etc. Similarly, a sandwich may include a dry bun and one or more moist toppings, such as pickles. During the time before the food product is consumed, heat and/or moisture can flow between adjacent ingredients, potentially resulting in a cold burger and/or a soggy bun.

SUMMARY

A container is provided that includes a container body having an interior space. The container body has a base portion and a top portion, the top portion being pivotally connected to the base portion. The container further includes an integral divider wall that separates the upper and lower portions of the container when the top portion of the container is closed onto the base portion, which then divides the interior space into a top interior portion and a base interior portion. In this way, separate food products of different temperatures and/or different moisture levels can be separated from each other between the two interior space portions. For example, a hamburger can be stored in the lower portion of the interior space while the cold condiments and toppings are stored in the upper portion.

In the preferred form, the divider wall includes a projection that extends outwardly from one edge of the divider wall. The projection is coplanar with the divider wall. The projection is sized and configured to rest on an upper edge of an upstanding, supporting wall of the base portion when the top portion is downwardly closed upon the base portion, which then divides the interior space into the two portions. The use of the upper edge of the base portion upstanding wall to support the divider wall, as opposed to downwardly projecting feet which could have been attached to or made a part of the divider wall to help support it, increases the amount of space in the base portion of the container for food. Additionally, the use of a coplanar projection, as opposed to a projection configured to be folded or pivoted, reduces the amount of folding necessary to assemble or erect the container from a blank, thus reducing the amount of time construction takes.

Also in the preferred form, a slot is provided in the in the container body, through a hinge which connects the upper and base portions of the interior space of container body. The slot is sized and configured to receive the projection of the divider wall, so as to support the divider wall in a horizontal position between the upper and base portions of the interior space.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

The container being described includes a body comprised of a base portion and a top portion, each pivotally and integrally attached to each other to define an interior space of the container when the two portions are closed upon each other. The container body further includes an integral divider wall that separates the interior space into an upper portion and a lower portion.

The divider wall is integral with and pivotally attached to one of the base portion and the top portion along at least a portion of a first edge of the divider wall. At least one second edge of the divider wall includes a projection extending therefrom with the projection extending through a slot or aperture in an upstanding wall of the container body when the container is closed and the divider wall in the operable position, which separates the top interior space from the bottom interior space.

Figure 2:
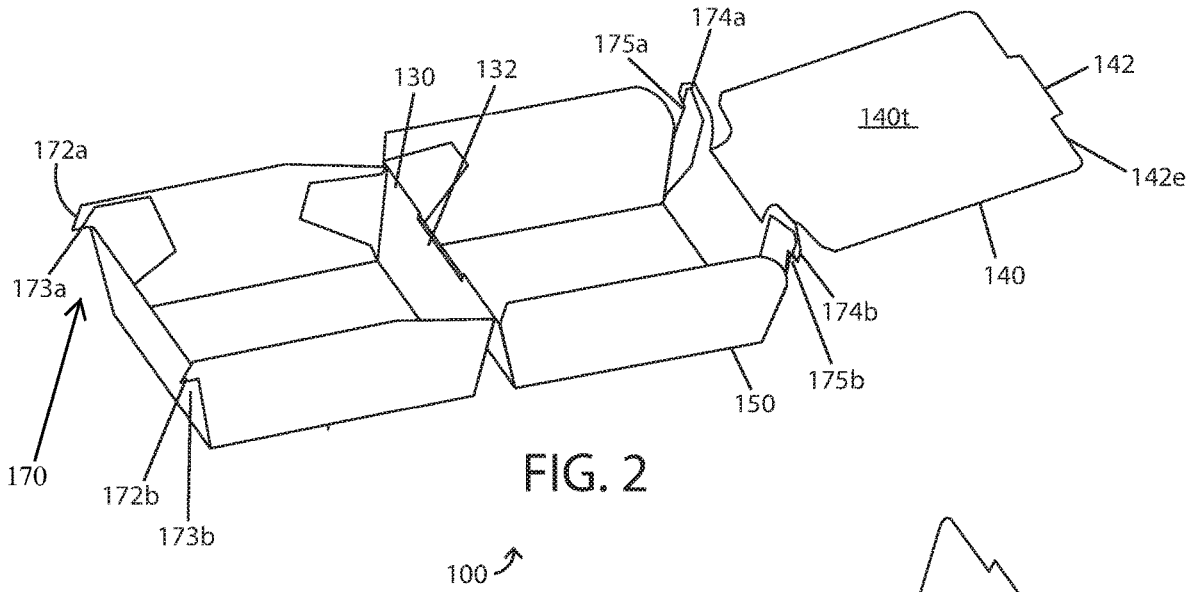
FIG. 2 is a perspective view of the container in an assembled or erected configuration showing the base portion, top portion, and divider wall in an open state.
Figure 3:
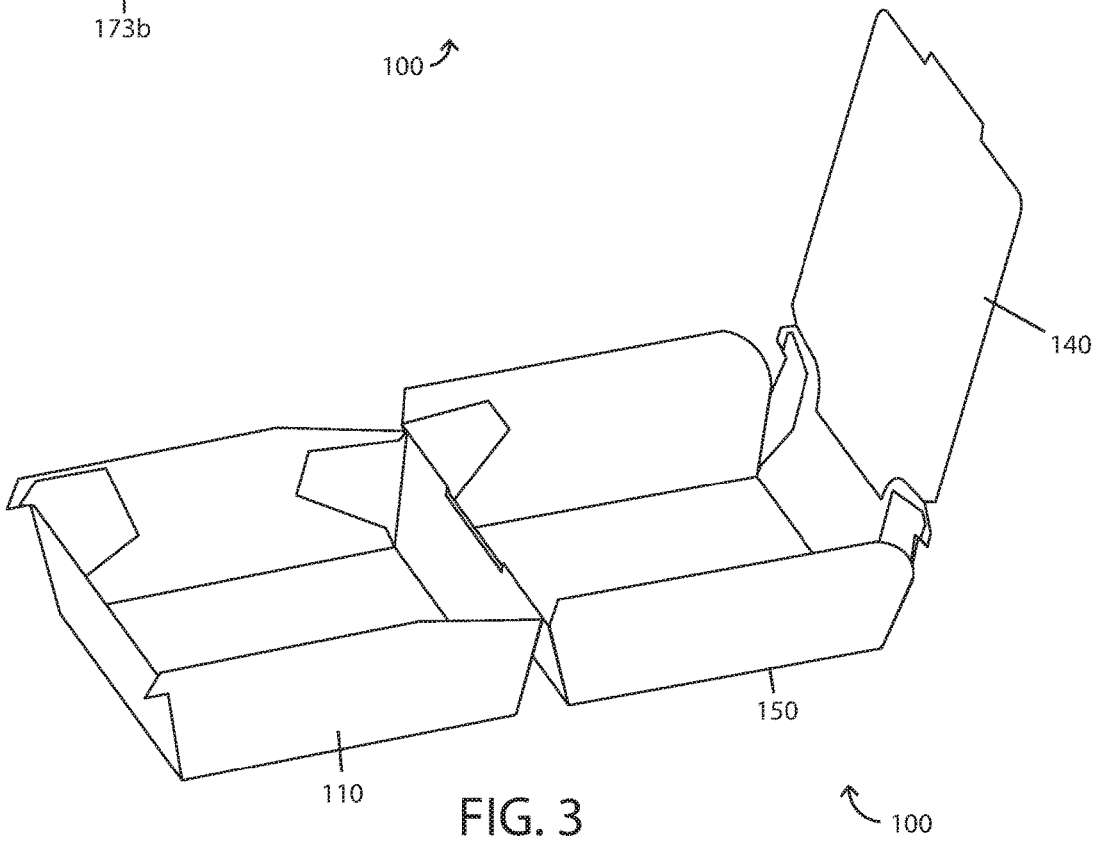
FIG. 3 is a perspective view of the container showing the divider wall being pivoted toward an operable position.

In a preferred form, the divider wall is pivotally attached to the top portion of the container body. In this configuration, the divider wall has a top surface that is oriented to face upward when the container is in a fully closed state. When the container is in a fully open state, such as when it is initially opened on a prep table or other supporting surface prior to loading any food into the container, the bottom panel of the base portion and top panel of the top portion are resting on the support surface, with the top surface of the divider wall facing downward towards the supporting surface, best seen in FIG. 2. After the crown part of the burger bun is loaded into the open top portion with the flat part of the crown facing upwards, the condiments are stacked on top of the flat part. Likewise, the heel part of the burger bun and the burger patty are loaded into the base portion of the container. The divider wall is then moved from the totally open position shown in FIG. 2, to the position shown in FIG. 3 and then to the position shown in FIG. 4 with the divider wall in a closed state with the top portion. The top portion of the container is then ready to be moved into a closed state with the bottom portion of the container and in FIG. 5, it is seen that top portion 150 has been moved towards bottom portion 110. With the container in the fully closed state, as that shown in FIGS. 6-8, the divider wall is considered to be in its operable position with its top surface facing panel 152 and supporting the food products stored within the upper portion of the interior space. When the container top and bottom portions are again shifted to the open state, the divider wall can be unsecured from and pivoted away from the top portion so that the food products stored in this half of the container can be exposed and made accessible so that the consumer can either remove the crown of the bun and its condiment contents for placement onto the heel of the bun and the burger patty, or the bottom portion of the container can be closed onto the top portion so that the sandwich is fully assembled without touching any of the contents within either portion of the container. In this fully opened position, the top surface of the divider wall is facing downwardly.

Figure 1A:
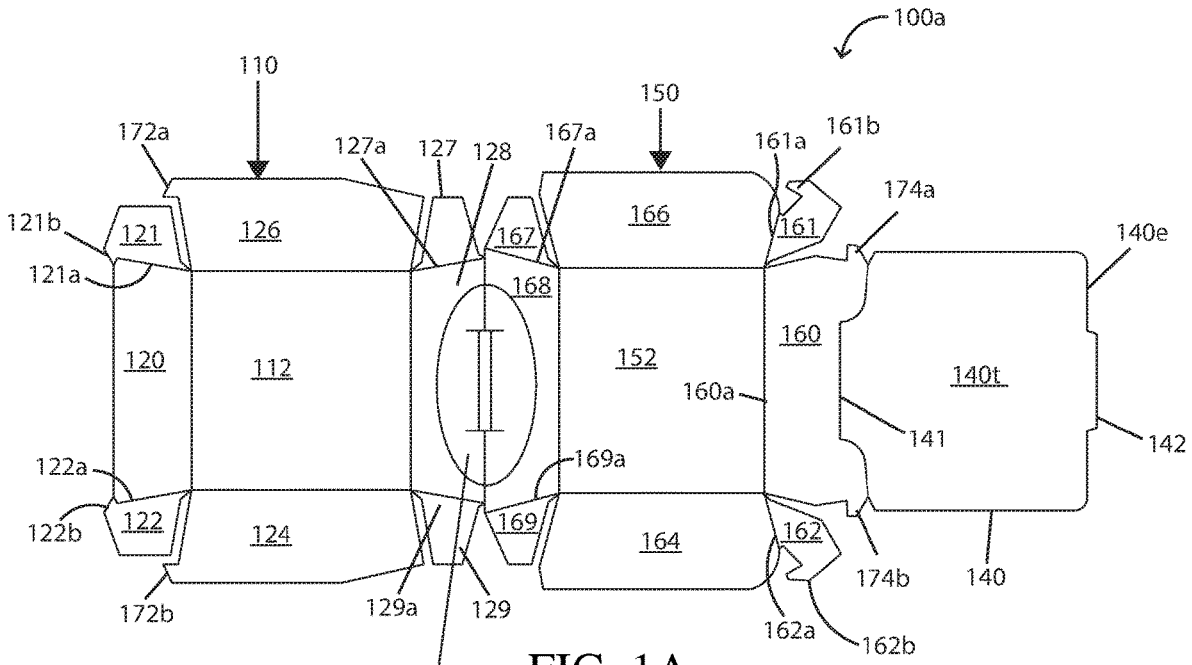
FIG. 1A is a plan view of a blank of a container having an integrally-connected divider wall.
Figure 1B:
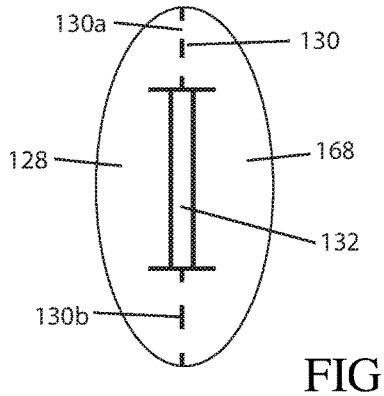
FIG. 1B is an enlarged view of a portion of a rear wall of the container of FIG. 1A showing a slot extending along a fold line between a top portion and a base portion of the container.

One exemplary container will now be described. FIG. 1A illustrates a blank 100*a* for the container 100 in a preferred form. The container 100 has a body 100*b* that includes a base portion 110, a top portion 150, and a divider wall 140. The container 100 is formed from the blank 100*a* which has a unitary and planar configuration, preferably of paper, a corrugated paper structure, or paperboard material. For example, panels or walls of the container 100 may be formed of single or double faced fluted sheets such as an "O", "G", "N", "E" or "F" flute sheet. Typically, containers for sandwiches sometimes referred to as clamshells are constructed from F flute which is considered to be a micro-flute. The container 100 is formed of a single sheet of material die cut into a blank 100*a* such that each portion of the container 100 is integrally formed. Any suitable die cutting process may be used to include rotary or flat die cutting.

The base portion 110 includes a bottom panel 112 having four edges defined by fold lines. The fold lines may be scored in any known manner to aid in folding. When the container 100 is assembled from the blank 100*a*, four upstanding walls are formed which are attached to the bottom panel 112 along respective edges thereof. The upstanding walls include two opposite, upstanding sidewalls 124, 126, an upstanding front wall 120, and an upstanding rear wall 128 opposite the front wall 120.

The front wall 120 includes securing flaps 121, 122 which are pivotably attached thereto along fold lines 121*a* and 122*a*. During assembly of the container, the securing flaps 121, 122 are folded relative to the front wall 120 along fold lines 121*a*, 122*a* such that they extend along inner surfaces of respective sidewalls 126, 124 and are glued thereto. As shown, the securing flaps 121, 122 are smaller relative to the sidewalls 126, 124, therefore in an assembled or erected state, the securing flaps 121, 122 do not extend the entire distance from the bottom of the sidewalls 124, 126 to the top. The securing flaps 121, 122 include respective projections 121*b*, 122*b*. The projections 121*b*, 122*b* are sized and configured to extend along at least a portion of the protrusions 172*a*, 172*b* when the container 100 is in an erected state. As such, the projections 121*b*, 122*b* serve to reinforce the protrusions 172*a*, 172*b*, increasing the resiliency thereof.

Similarly, the rear wall 128 includes securing flaps 127, 129 which are pivotally connected along fold lines 127*a*, 129*a* so as to fold to extend along inner surface of the respective sidewalls 126, 124. As shown, the securing flaps 127, 129 are smaller relative to the sidewalls 126, 124, therefore in an erected state, the securing flaps 127, 129 do not extend the entire distance from the bottom of the sidewalls 124, 126 to the top.

The securing flaps 121, 122, 127, 129 are secured to the corresponding sidewalls 126, 124, thus securing the base portion 110 in an erected state, with the bottom panel 112 and upstanding walls 120, 124, 126, 128 defining a lower portion of the interior space of the container 100. The securing flaps 121, 122, 127, 129 can be attached by an adhesive, such as a hot melt or cold melt adhesive. The adhesive can be a starch based adhesive or other type of adhesive usable in compostable, repulpable, and/or recyclable containers.

The securing flaps 121, 122, 127, and 129 each have upper edges substantially coplanar with the slot 132. With the container 100 in a fully closed position, the divider wall 140 rests on the top edges of the securing flaps 121, 122, 127, and 129. This added support reduces potential deformation of the divider wall 140 as a result of the weight of the food products stored in the upper cavity.

Figure 4:
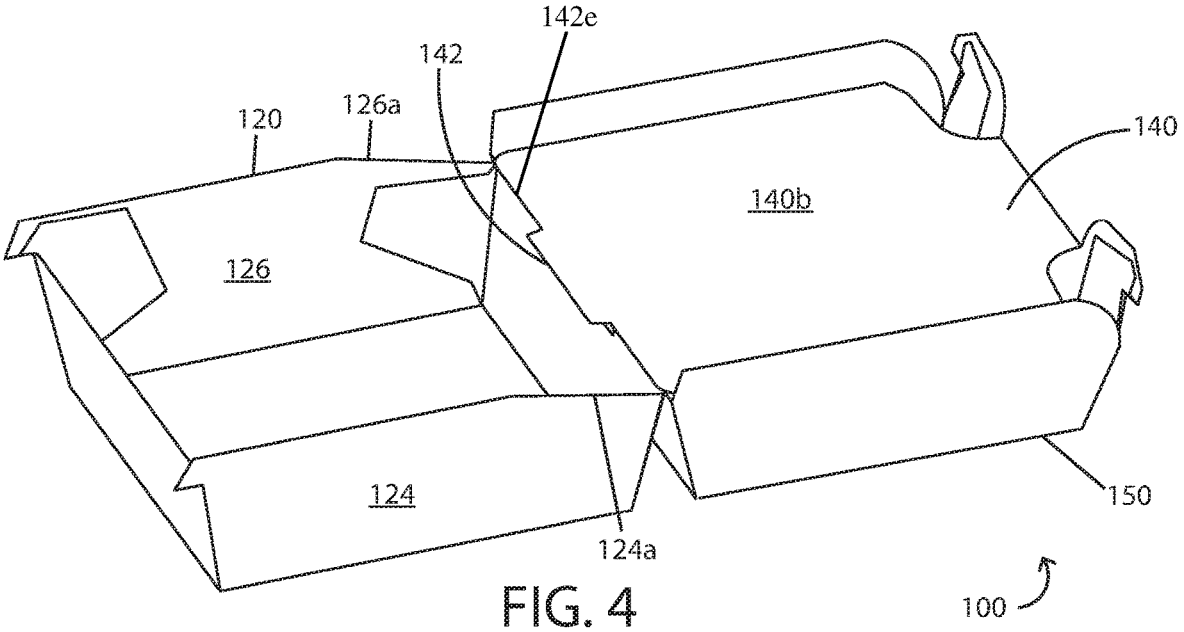
FIG. 4 is a perspective view of the container showing the divider wall in the operable position and the container base portion and top portion in an open state relative to each other.
Figure 5:
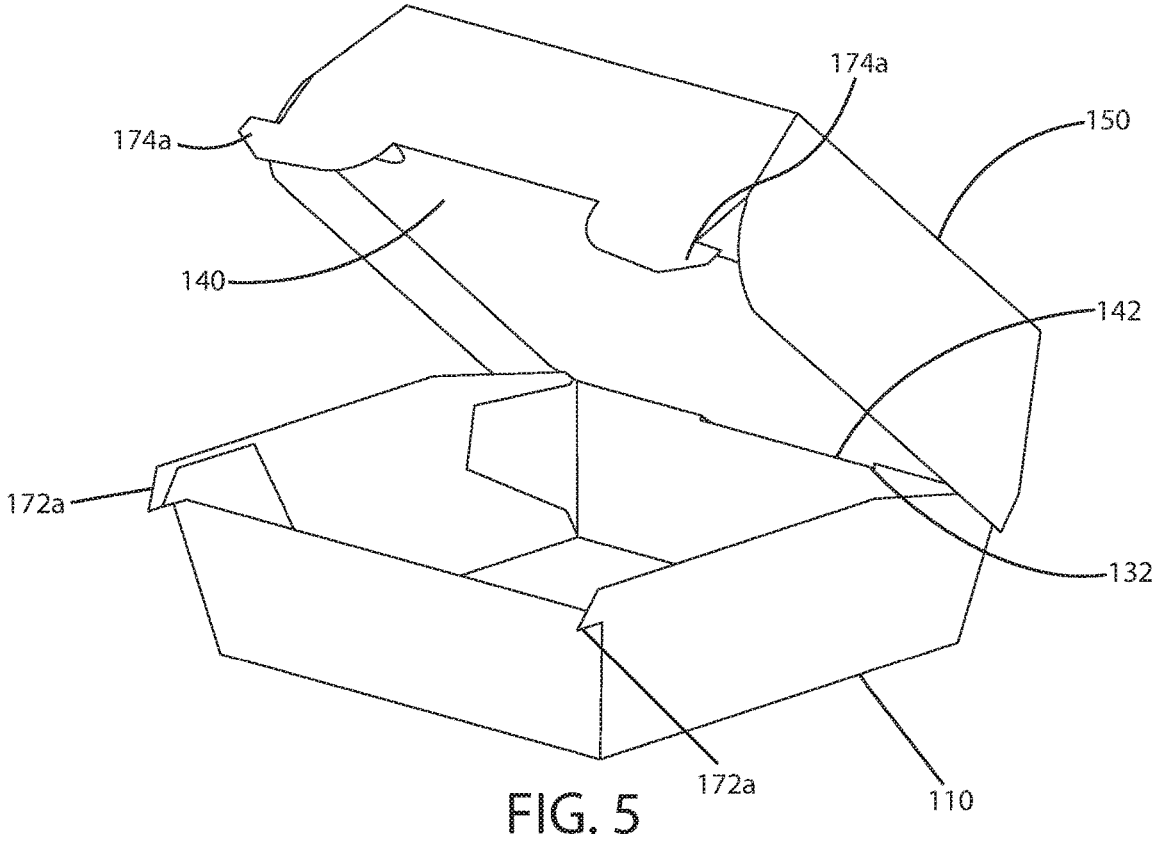
FIG. 5 is a perspective view of the container showing with the top portion and base portion being pivoted toward a closed state.

The upstanding sidewalls 124, 126 include cam surfaces 124*a*, 126*a*. The cam surfaces 124*a*, 126*a*, as best seen in FIGS. 4 and 5, have a downwardly sloping profile, with the end of the cam surfaces 124*a*, 126*a* closest to the hinge 130 being lower than the other end. In alternative embodiments, the divider wall 140 is at least as wide as the distance between the upstanding sidewalls 226, 224. During closing, the edge 140*e* of the divider wall contacts at least one of the cam surfaces 124*a*, 126*a* and slides along the surface thereof into closed position with respect to the top portion 150.

The top portion 150 includes a top panel 152 having four edges defined by scores or fold lines. When the container 100 is erected from the blank 100*a*, four depending walls are provided which are pivotally attached to the top panel 152 along respective edges. The depending walls include two opposite, depending sidewalls 164, 166, an upstanding front wall 160, and an upstanding rear wall 168 opposite the front wall 160.

The sidewalls 166, 164 include respective securing flaps 161, 162 attached thereto. During assembly, the securing flaps 161, 162 are folded relative to the sidewalls 166, 164 along fold lines 161*a*, 162*a* such that they extend along an inner surface of the front wall 160. As shown, the securing flaps 161, 162 are smaller relative to the front wall 160, therefore in an erected state, the securing flaps 161, 162 do not extend the entire distance from the bottom of the front wall 160 to the top. The securing flaps 161, 162 include respective projections 161*b*, 162*b*. The projections 161*b*, 162*b* are sized and configured to extend along at least a portion of the protrusions 174*a*, 174*b* when the container 100 is in an erected state. As such, the projections 161*b*, 162*b* serve to reinforce the protrusions 174*a*, 174*b*, increasing the resiliency thereof.

Similarly, the rear wall 168 includes securing flaps 167, 169 which are pivotally connected along fold lines 167*a*, 169*a* so as to fold to extend along inner surface of the respective sidewalls 166, 164. As shown, the securing flaps 161, 162 are secured to the front wall 160 and the securing flaps 167, 169 are secured to the respective sidewalls 166, 164, thus securing the top portion 150 in an erected state, with the top panel 152 and depending walls 160, 164, 166, 168 defining an upper portion of the interior space of the container 100. The securing flaps 167, 169 are smaller relative to the sidewalls 166, 164, therefore in an erected state, the securing flaps 167, 169 do not extend the entire distance from the bottom of the sidewalls 164, 166 to the top.

The securing flaps 161, 162, 167, 169 can be attached by an adhesive, such as a hot melt or cold melt adhesive. The adhesive can be a starch based adhesive or other type of adhesive usable in compostable, repulpable, and/or recyclable containers.

The securing flaps 121, 122, 127, 129, 161, 152, 167, 169 are smaller relative to the respective walls along which they extend. When the container 100 is in an erected state, the upper and lower edges of the securing flaps 121, 122, 127, 129, 161, 152, 167, 169 are respectively spaced below and above the upper and lower edges of the corresponding walls. As such, there are tolerances built into the container 100 such that a securing flap 121, 122, 127, 129, 161, 152, 167, 169 that is cut to the wrong shape, or folded along the wrong line can still be completely overlapped by the respective walls, thus not affecting the outward appearance of the container 100.

The fold lines 121*a*, 122*a*, 127*a*, 129*a*, 161*a*, 162*a*, 167*a*, 169*a* are oblique relative to the fold lines defining the bottom panel 112 and top panel 152. As such, the container 100 is configured such that, when in an erected state, the upstanding and depending walls angle outward relative to the respective bottom and top panels 112, 152. Therefore, the horizontal cross section of the container 100 is larger along the plane of the divider wall 140 than along the planes of the top or bottom panels 112, 152.

The rear walls 168 and 128 are integrally connected together along a common fold line or living hinge 130 about which they pivot relative to each other. An aperture or slot 132 is formed adjacent to or along the hinge 130 so that the hinge 130 is broken into hinge side portions 130*a* and 130*b* thereof on either side of the slot 132. The slot 132 is disposed near the respective top edge of each rear wall 128 and 168 such that at least a portion of the slot 132 extends into and through the bottom rear wall 128 and through the top rear wall 168.

The divider wall 140 has one end pivotally coupled to the front wall 160 of the top portion 150 by a living hinge or fold line 141. As shown, the fold line 141 is located at the top of the front wall 160. The other end of divider wall 140 includes a projection or protrusion 142 extending from the edge 140*e*. The protrusion 142 is sized and configured to be received within the slot 132 when the container 100 is closed (see FIG. 8). In one form, the protrusion 142 is located proximate the center of the one end of the divider wall 140. The protrusion 142 extends away from edge 140*e* about a half inch and it also has a lateral extent approximately one third to one half of the lateral width of the divider wall. In one example, the divider wall is laterally about 5 inches wide and the protrusion is about 2 inches laterally wide along protrusion end 142. The protrusion end 142*e* is laterally smaller than the extent of slot 132 in order to aid aligning the protrusion 142 within the slot 132. The protrusion 142 is integrally a part of the divider wall 140 and as such, is coplanar with the divider wall 140.

In alternative forms, additional divider walls can be included. The additional divider walls can be pivotably coupled to the front wall of the bottom portion or to one of the sidewalls of either or both of the top and bottom portions.

Figure 6:
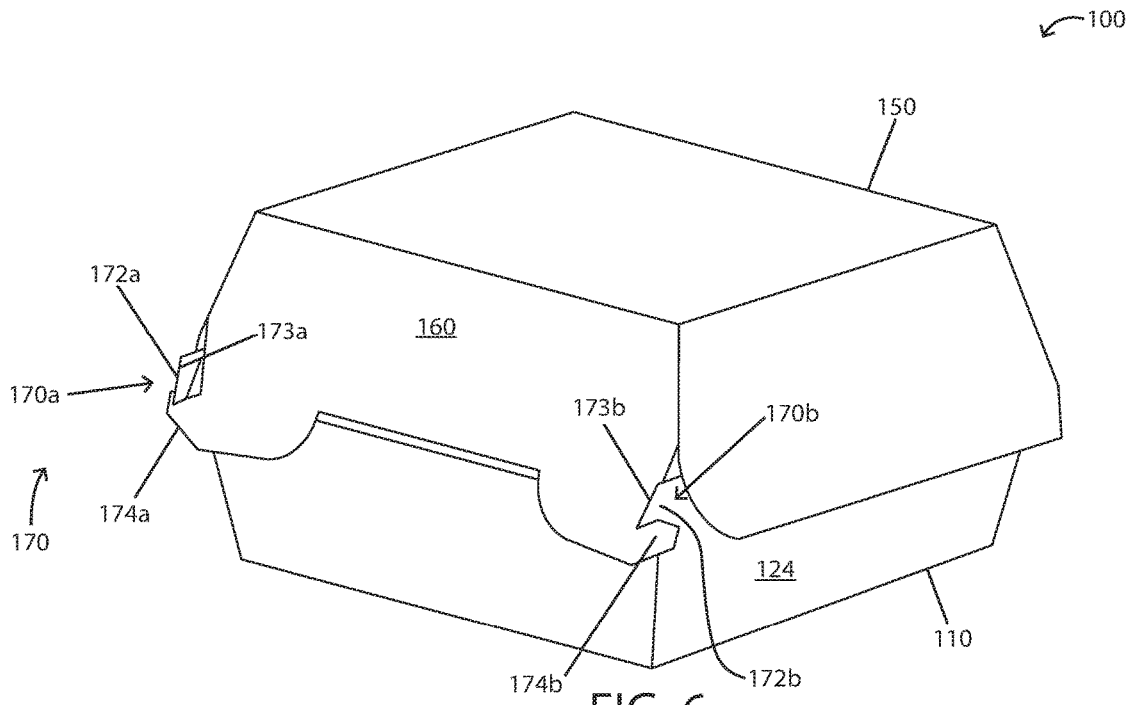
FIG. 6 is a perspective view of the container showing the top portion and base portion in the fully closed state.
Figure 7:
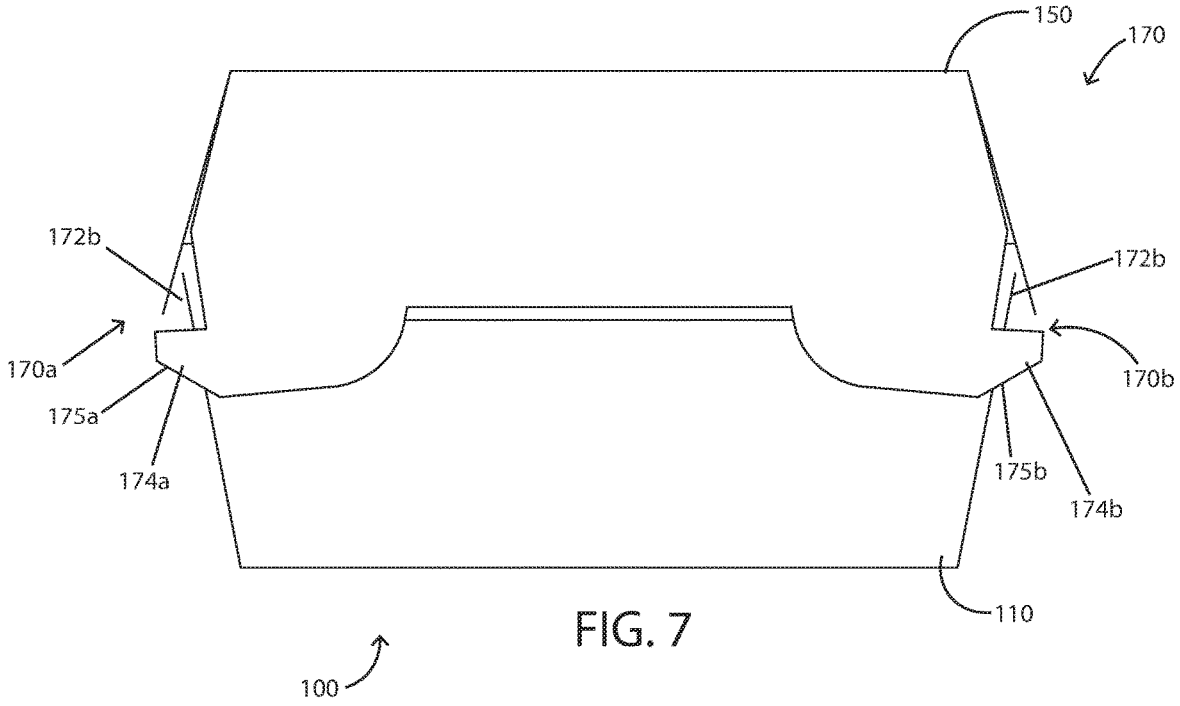
FIG. 7 is a front elevational view of the fully closed container showing the locking structure releasably securing the top portion relative to the base portion.
Figure 8:
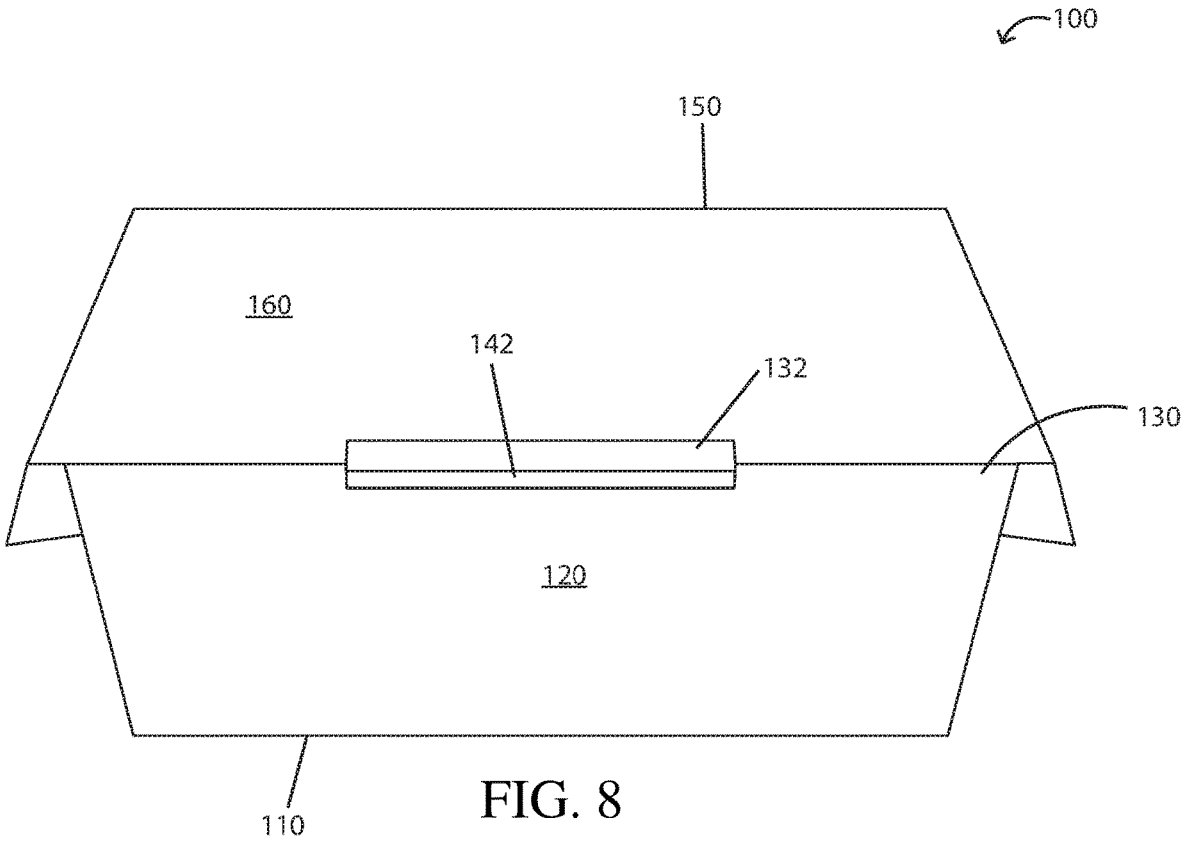
FIG. 8 is a rear elevational view of the fully closed container showing a projection of the divider wall extending through the slot.

A resilient lock 170 secures the top portion 150 to the bottom portion 110 when the container 100 is in a closed position as shown in FIGS. 6-8. Turning to FIGS. 6-7, one form of resilient lock 170 includes two resilient locks 170*a*, 170*b* located proximate to the front corners of the container 100. The first resilient lock portion 170*a* includes a protrusion 174*a* of the top portion 150 configured to interlock with a protrusion 172*a* of the base portion 110.

The upper protrusion 174*a* includes a diagonal cam surface 175*a*. When the front wall 160 is moved downward relative to the front wall 120 during closing, the cam surface 175*a* acts upon the protrusion 172*a* to deflect it outward. This deflection enables the protrusions 172*a*, 174*a* to pass by each other. The protrusion 172*a* resiliently springs inward after passing by the protrusion 174*a*, such that they overlap in a horizontal direction, forming an interference lock.

Alternatively or additionally, the protrusion 172*a* has a cam surface 173*a* for similarly causing the protrusion 174*a* to deflect during closing of the container. The second resilient lock 170*b* is substantially similar to the first resilient lock 170*b*. The second resilient lock 170*b* includes a protrusion 174*b* of the top portion 150 configured to interlock with a protrusion 172*b* of the base portion.

As shown, the upper protrusions 174*a*, 174*b* are part of the front wall 160. The upper protrusions 174*a*, 174*b* extend downward and outward relative to the fold line 141. The lower protrusions 172*a*, 172*b* are part of respective sidewalls 126, 124. In alternative embodiments, the resilient locks 170*a*, 170*b* are reversed such that the locking protrusions are portions of the front wall 120 and side walls 166 and 164.

The locking protrusions 172*a*, 172*b*, 174*a*, 174*b* are partially formed of the securing tabs 121, 122, 161, 162 respectively. Thus, the locking protrusions 172*a*, 172*b*, 174*a*, 174*b* are double the thickness of the walls of the container. This double layering of the protrusions 172*a*, 172*b*, 174*a*, 174*b* makes them more resilient, such that the protrusions 172*a*, 172*b*, 174*a*, 174*b* more reliably spring back after being deformed by the cam surfaces during closing.

The upper protrusions 174*a*, 174*b* extend downward below the fold line 141 when the upper portion 150 is in a closed position as shown in FIG. 6. Alternatively or additionally, the lower protrusions 172*a*, 172*b* extend upward beyond the top edge of the front wall 120. As such, the fold line 141 is proximate the top edge of the front wall 120, and the upper protrusions 174*a*, 174*b* overlap in a vertical direction with the lower protrusions 172*a*, 172*b*.

In operation, the container 100 is erected from the blank 100*a* (see FIG. 1A) to form an open container (see FIG. 2) by pivoting and securing the walls and securing flaps as described above. The open container 100 is loaded with food products divided into two sections (e.g., hot and cold or wet and dry). The first section of food stuff is loaded into the base portion 110. The second section of food products is loaded into the top portion 150.

The divider wall 140 is pivoted relative to the top portion 150 about the fold line 141 until the divider wall 140 is substantially parallel to the top panel 152, as shown in FIG. 4. This encloses the second section of food in the upper portion in the interior space of the container 100. The top surface 140*t* faces inward into the cavity defined by the top portion 150.

While keeping the divider wall 140 in position relative to the upper portion 150, the upper portion 150 is pivoted relative to the base portion 110 about the hinge 130 into the closed position shown in FIG. 6. Near the end of the pivoting, the top portion 150 is pressed onto the bottom portion 110, causing the resilient lock 170 to deform and then releasably secure the top portion 150 in place.

During the pivoting of the top portion 150 relative to the bottom portion 110, the protrusion 142 passes at least partially into the slot 132. With the container in the closed position, the protrusion 142 rests on an upper surface of the rear wall 128, supporting the divider wall 140 in a substantially horizontal position.

In a preferred form, the protrusion 142 extends at least partially past the living hinge 130. As shown in FIG. 4, the divider wall 140 is sized such that the edge 142*e* is proximate the hinge 130. The protrusion 142 extends approximately about ⅛ to about ⅝ of an inch from the edge 142*e* such that it extends through the slot 132 when the container 100 is closed.

The slot 132 has a portion that extends below hinge 130 to provide clearance for the protrusion 142 to enter the slot during closing of the top portion 150 of container 100. The protrusion 142 initiates entry into the slot 132 when the top portion 150 is pivoted to just less than 90 degrees relative to the bottom portion 110, with entry progressing as the angle between the portions lessens. As shown in FIG. 5, the top portion 150 is positioned at about 45 degrees relative to the bottom portion 110. The protrusion 142 at this angle is substantially positioned within the slot 132 and when both portions are fully closed, the divider wall 140 is fully secured within slot 132, thereby closing off the interior of the top portion 150. During the progression of closing the top portion 150, the person closing that portion will typically push against the bottom surface of divider wall 140 to prevent the crown of the bun and the condiments from falling out during closing of the top portion of the container 100.

The divider wall 140 is integrally and hingedly attached at the fold line 141 to a side of the top portion 150 which is opposite the side of the top portion 150 having the living hinge 130. (See FIG. 1A). The protrusion 142 is on the edge 142*e* of the divider wall 140 opposite the fold line 141. As the top portion 150 is pivoted upward from the horizontal, gravity holds the divider wall 140 in engagement with the top portion 150 such that the protrusion 142 is proximate the hinge 130. When the top portion 150 passes the vertical or 90 degree position during closing, the protrusion becomes secured within the slot 132. This securement within the slot 132 remains as such until the divider wall is rotated in an opposite direction and more than 90 degrees, whereby protrusion 142 releases from within slot 132.

With the container 100 in the upright position, the food product in the upper cavity rests on and contacts the top surface 140*t* of the divider 140. The food product in the lower cavity rests on the bottom panel 112, spaced apart from the bottom surface 140*b* of the divider wall 140. By this configuration, the bottom surface 140*b* remains relatively clean compared to the top surface 140*t*. When the container 100 is opened by reversing the steps above, the top surface 140*t* remains facing upward (see FIG. 2), thus reducing the transfer of food residue from the divider wall 140 to any adjacent surfaces, such as a table top.

In the example of a sandwich, such as a hamburger, the top piece of bread or the crown, is placed in the top portion of the open container with the top surface of the crown being placed against the top panel 152. The toppings and/or condiments are then placed on the flat surface of the crown. The bottom piece of bread or heel, is placed in the bottom portion 110 of the container 100 with the bottom surface of the heel against the bottom panel 112. The meat or patty is placed on the opposite of surface of the heel. In operation, the divider wall 140 is used to separate the two portions of the sandwich during transportation. For assembly of the two halves of the sandwich, the container 100 is first opened such that each container half, 110 and 150 is disengaged from each other and pivoted along living hinge 130, away from each of the. The protrusion 142 of the divider wall 140 is then disengaged from slot 132 such that the entire divider wall is pivoted along hinge 141 to expose the contents of the top portion. The top portion 150 is then again closed onto the bottom portion 110 to allow the contents thereof to be directed onto the contents of the bottom portion, thereby assembling the sandwich without the necessity of touching the food.

In alternative embodiments, the divider wall 140 includes at least one protrusion of one or both side edges. The side protrusions are generally coplanar with the divider wall 140, and sized and configured to either rest on the top edge of the sidewalls 124, 126 when the container is in a closed position or they may insert within the additional slots provided in sidewalls 164, 166. The side protrusions can be used in addition to or as an alternative to the protrusion 142. If the divider wall is provided in association with the bottom portion of the carton, then the side protrusions would rest on the top edges of the sidewalls 164, 166 when the container is in a closed position or they may be received within the additional slots provided in sidewalls 124,126.

In some forms, the divider wall 140 is pivotally coupled to one of the upstanding walls 120, 124, 126. During opening of the container, the second section of food products remains resting on the divider wall 140 over top of the bottom portion 110 as the top portion is pivoted out of the way. As such, the food product is not flipped over during opening, which is desirable for some food products, such as pizza. One or more protrusions are configured to rest on a top edge of at least one upstanding wall on a side of the container 100 other than the side to which the divider wall is pivotally attached. At least one of the one or more protrusions is proximate an edge opposite of the edge along which the divider wall is attached.

In alternative embodiments, alternative locking structures are used to secure the container in a closed position. For example, a first of the top portion 150 and bottom portion 110 includes a projection sized and configured to be received in an aperture or slot in the other of the top portion 150 and bottom portion 110.

In addition, one skilled in the art will appreciate variations in the above-described containers and related methods can be provided. For example, the number of upstanding and depending walls can change to alter the shape of the container. Additionally, one skilled in the art will appreciate that a variety of methods are contemplated in the description above. For example, methods of making a divided container and methods of using the same.

Those skilled in the art will recognize that a wide variety of modifications, alterations, and combinations can be made with respect to the above described embodiments without departing from the spirit and scope of the invention, and that such modifications, alterations, and combinations, are to be viewed as being within the scope of the invention.

What is claimed is:

1. A container comprising:

a container body having an interior space;

a base portion and a top portion of the container body that are pivotally connected by a hinge;

a divider wall of the container body that separates upper and lower portions of the interior space with the top portion closed on the base portion;

a slot of the container body that extends through the hinge; and a projection of the divider wall sized to fit into the slot to support the divider wall in position between the upper and lower portions of the interior space with the top portion closed on the base portion.

2. The container of claim 1 wherein the projection is generally coplanar with the divider wall.

3. The container of claim 1 wherein the divider wall is pivotally connected via a second hinge to one of the base portion and the top portion, the second hinge being opposite the hinge connecting the base portion to the top portion.

4. The container of claim 3 wherein the divider wall is pivotally connected to the top portion.

5. The container of claim 1, wherein the base portion includes a plurality of upstanding walls including a rear upstanding wall, the slot disposed along a top edge of the rear upstanding wall.

6. The container of claim 1, wherein the container is formed of one of paper, corrugated paper, and paperboard.

7. A container comprising:

a bottom portion including:

a bottom panel;

a rear upstanding wall extending upwardly from a first peripheral edge of the bottom panel;

a front upstanding wall extending upwardly from a second peripheral edge of the bottom panel, the second peripheral edge being opposite of the first peripheral edge;

first and second upstanding sidewalls extending from opposite peripheral edges of the bottom panel;

a top portion including:

a top panel;

a rear depending wall extending downwardly from a first peripheral edge of the top panel, the rear depending wall coupled to the rear upstanding wall by a living hinge;

a front depending wall extending downwardly from a second peripheral edge of the top panel, the second peripheral edge being opposite of the first peripheral edge;

first and second depending sidewalls extending from opposite peripheral edges of the top panel;

a generally flat divider coupled to one of the rear upstanding wall, front upstanding wall, first and second upstanding sidewalls, rear depending wall, front depending wall, and first and second upstanding walls by a living hinge at a first peripheral edge of the divider, the divider including a projection extending from a second peripheral edge of the of the divider, the second peripheral edge being opposite to the first peripheral edge.

8. The container of claim 7 wherein the divider is coupled to one of the front upstanding wall and the front depending wall.

9. The container of claim 7, the first and second upstanding sidewalls each including a locking projection extending forward of the front upstanding wall; and the front depending wall including first and second locking projections configured to engage the locking projections of the upstanding sidewalls.

10. The container of claim 7 wherein the projection is generally coplanar with the divider.

11. A blank for forming a container, the blank comprising:

a bottom panel;

a top panel;

a rear panel extending from a first peripheral edge of the bottom panel to a first peripheral edge of the second panel, the rear panel including a score generally parallel to the first peripheral edge of the bottom panel positioned between the bottom panel and top panel;

an aperture in the rear panel, the aperture being along the score;

a top front panel extending from a second peripheral edge of the top panel, the second peripheral edge being opposite the first peripheral edge;

a bottom front panel extending from a second peripheral edge of the bottom panel, the second peripheral edge being opposite the first peripheral edge;

a divider panel extending from one of the top front panel and the bottom front panel, the divider panel including a projection sized to be received in the aperture.

12. The blank of claim 11, the top front panel including two locking projections.

13. The blank of claim 11 further comprising:

a first bottom side panel extending from a third peripheral edge of the bottom panel;

a second bottom side panel extending from a fourth peripheral edge of the bottom panel; and a locking projection extending from one of the first and second bottom side panels.

14. A method of forming a container comprising:

pivoting a divider wall relative to a top portion about a first hinge, the first hinge integrally connecting the divider wall to a first edge of the top portion;

pivoting the top portion relative to a base portion about a second hinge, the second hinge integrally connecting the base portion second edge, opposite the first edge, of the top portion; and inserting a projection of the divider wall into an aperture extending through the second hinge.

15. The method of claim 14 further comprising locking the projection between the top portion and the bottom portion.

16. The method of claim 14 wherein the pivoting of the top portion relative to the base portion causes the insertion of the projection into the aperture.

* * * * *